US008876417B2

(12) United States Patent
Kadis et al.

(10) Patent No.: US 8,876,417 B2
(45) Date of Patent: Nov. 4, 2014

(54) PAPER SENSING IN PRINTERS

(75) Inventors: Giries Kadis, Jaffa (IL); Sharon Nagler, Gan Yavna (IL); Gregory Brusilovski, Raanana (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 2197 days.

(21) Appl. No.: 11/829,767

(22) Filed: Jul. 27, 2007

(65) Prior Publication Data

US 2009/0028621 A1 Jan. 29, 2009

(51) Int. Cl.

| | |
|---|---|
| ***B41J 13/00*** | (2006.01) |
| ***G03G 15/00*** | (2006.01) |
| ***B65H 7/06*** | (2006.01) |
| *B41J 11/00* | (2006.01) |

(52) U.S. Cl.

CPC ..... *B65H 7/06* (2013.01); *B65H 2553/60* (2013.01); *B65H 2406/30* (2013.01); *B65H 2406/10* (2013.01); *B65H 2511/51* (2013.01); *B65H 2515/342* (2013.01); *B41J 11/0095* (2013.01); *G03G 15/70* (2013.01); *G03G 2215/1695* (2013.01); *G03G 15/6558* (2013.01)

USPC ..... 400/578; 399/21; 399/22; 399/23; 399/305; 271/196

(58) Field of Classification Search

USPC ..... 399/21, 305, 320, 400; 271/303, 196, 271/197; 400/578

See application file for complete search history.

(56) References Cited

U.S. PATENT DOCUMENTS

| | | | | |
|---|---|---|---|---|
| 3,416,863 | A * | 12/1968 | Ralston | 355/110 |
| 4,084,806 | A * | 4/1978 | Wenthe et al. | 271/314 |
| 4,959,693 | A * | 9/1990 | Mitsuya et al. | 399/322 |
| 6,892,047 | B1 * | 5/2005 | Giannetti et al. | 399/400 |
| 6,957,035 | B1 * | 10/2005 | Giannetti et al. | 399/322 |
| 7,021,622 | B2 * | 4/2006 | Carter et al. | 271/258.01 |

* cited by examiner

*Primary Examiner* — Matthew G Marini

(57) ABSTRACT

A paper sensor comprises a moveable grill. The paper sensor is arranged for location within an air flow in a printer, and comprises the grill as a paper-engaging body provided with a plurality of through holes such that air can flow freely through the grill. The grill is operable to move between a first position and a second position. The paper sensor is arranged so that in use a sheet of paper introduced adjacent the grill engages the grill and reduces the air flow through one or more of the holes in the grill, creating a pressure differential across the grill, that pressure differential causing the grill to move from the first position to the second position, and thereby indicating the presence of paper. A printer comprising a paper sensor, and a method of sensing paper is also disclosed.

19 Claims, 4 Drawing Sheets

PAPER SENSING IN PRINTERS

FIELD OF THE INVENTION

The invention relates to a paper sensor for sensing the existence of paper in a printer, printers including such paper sensors, and a method of sensing paper. The invention relates particularly, but not exclusively, to a mechanical paper sensor adapted for use at or near to an external heating element of a large-scale, industrial printer.

The word 'paper' is used herein to include any sheet-like medium or substrate that may be printed on in a printer. Examples of such media include paper, envelopes, labels, cardboard, plastic, foil, textiles, and composites of those materials.

BACKGROUND OF THE INVENTION

Printing machines generally comprise a paper transfer path, along which paper can be moved from one location within the printer to another. For example, in some embodiments, paper may be picked up from a paper input tray, transported via a paper transport mechanism to an impression drum, where heated ink is transferred onto the paper, and finally transported to a paper output of the printer. Other paper handling mechanisms, such as duplexing, may additionally take place within the printer.

There is a problem with such a printer in that paper may stick or jam within the machines or arrive at an unwanted location.

In particular, in some existing printer machines heated ink is transferred onto a sheet of paper, while it is on the impression drum, by an intermediate transfer media (ITM) drum. The ITM drum typically, in some embodiments, comprises a charged blanket, which is heated by an heating unit external to the ITM drum. Ink on the blanket is liquefied (or kept liquid) by the heat of the blanket, for transfer to the sheet of paper. It is possible during printing for a sheet of paper to stick or adhere to the ITM drum, rather than being carried away to the paper output, and to arrive without warning at the external heating unit. This is undesirable, as the paper may be scorched or burnt by the external heating unit. Damage may be caused to the printer if the paper is not removed sufficiently quickly, or if the heating unit is not turned off. Furthermore, such paper jammed within the machine may cause the printer to operate incorrectly, resulting in spoiled, incorrectly printer paper being output by the printer. Such paper must be removed.

In order to remove paper that has become stuck in an undesired location, one must know that it is there. It is also desirable to find out that paper has arrived at the undesired location, such as the external heating element, before too many incorrect sheets have, been printed, and before damage is caused to the machine.

According to one aspect of the invention we provide a paper sensor as described in the claims.

Such a paper sensor provides an indication that paper has arrived at the external heating element, allowing the printer to be immediately switched off, avoiding the possibility of machine damage. The sensor additionally provides a physical barrier that prevents paper from moving inside the heating unit.

A printer comprising a paper sensor and a method of paper sensing are also described.

According to another aspect of the invention there is provided a paper sensor comprising a grill and a micro-sensor, the micro-sensor being operable to detect an increase in pressure on the grill (or a differential pressure across the grill). The micro-sensor may comprise a piezoelectric sensor. The increase in pressure may be due to a sheet of paper obstructing a flow of air through holes in the grill.

An embodiment of the invention will now be described, by way of example only, with reference to the following drawings.

DESCRIPTION OF THE PREFERRED EMBODIMENTS

Figure 1:
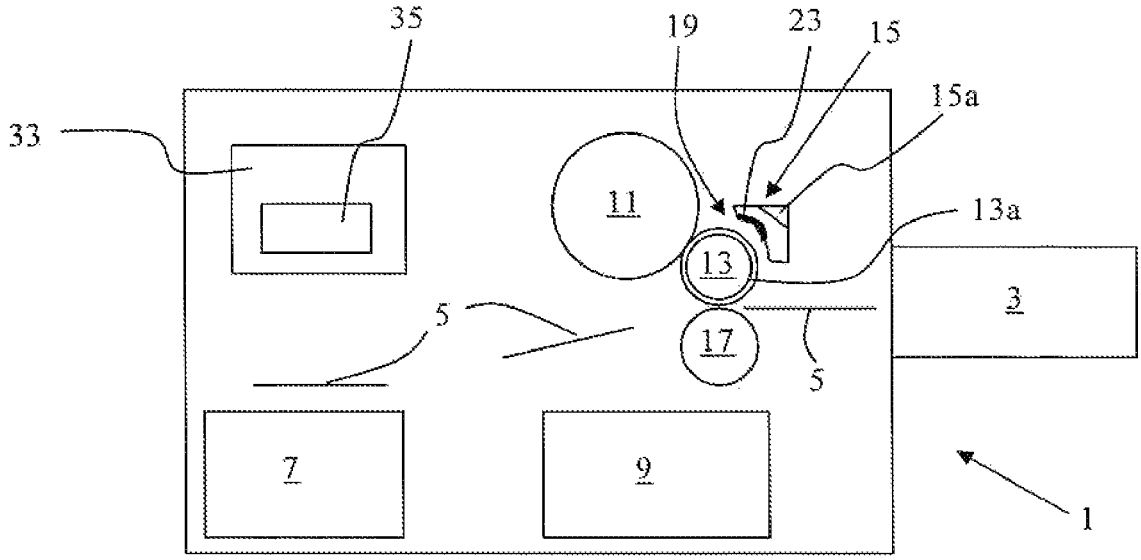
FIG. 1 is a schematic view of an embodiment of a printer which uses an embodiment of the invention.

Referring to FIG. 1, a printer 1 comprises a paper input unit 3 comprising one or more paper input trays (not shown), a paper transport path, indicated generally by paper 5 and a paper output area 7. The printer 1 further comprises an ink storage area 9 and a photo imaging plate (PIP) drum 11. Adjacent the PIP drum 11 is an intermediate transfer media (ITM) drum 13, a heating unit 15 external to the ITM drum 13, and an impression drum 17. The ITM drum and impression drum are in contact and biased towards each other under pressure. The ITM drum 13 comprises a blanket 13*a* that is capable of holding both heat and electric charge.

When the printer is in use, a charge pattern is developed on the PIP, for example by selectively illuminating parts of the PIP with a laser to charge or discharge a selected area. Ink is sprayed onto the PIP from the ink storage area, and ink is preferentially held to the charged areas of the PIP, in a known way. The blanket 13*a* is oppositely charged, again, in a known way. Consequently, ink is attracted from the PIP onto the blanket. The external heating unit 15 heats the blanket 13*a*, which melts the ink into a viscous liquid. A vacuum source 15*a* is provided within the heating unit, to remove vapours from the printer.

Paper 5 is carried from the input unit 3 towards the ITM drum 13 and the impression drum 17. As a sheet of paper moves between the ITM drum 13 and the impression drum 17, liquid ink is transferred onto the relatively cold paper, aided by the pressure between the two drums, and sets to form an image. The paper 5 is then carried by a series of rollers (not shown) to the paper output area 7.

Occasionally, a sheet of paper 5 may stick to the blanket 13*a* on the ITM drum 13. Rather than being carried to the output area 7, such a sheet of paper may be carried into an area 19 at or near to the external heating unit 15. The external heating unit 15 comprises heating elements 21 (shown in FIG. 2). If paper is carried in front of those elements 21 the paper may be scorched or burnt, which may result in damage to the printer. Furthermore, the paper may jam the printer, preventing an image from being correctly transferred between the PIP and the ITM drum, and resulting in incorrectly printed sheets that may need to be discarded.

A paper sensor 23 (best shown in FIG. 2 to 4) is provided to detect the presence of stray paper when it enters area 19, before it reaches the heating elements 21. The paper sensor 23 is located within a flow of air 25 into the external heating unit 15, the flow being caused by the vacuum source 15*a*. That flow of air 25 is used, as is conventional, to carry unwanted vapours from the printer. However, in accordance with the invention, the air flow 25 is also used as a mechanism for providing a trigger for the paper sensor 23.

The paper sensor 23 comprises a moveable grill or web 27. The grill (or grid, or mesh, or support frame) 27 is rigid and has a number of through holes 29. The grill 27 is thin, less than 1 cm in thickness (for example, about 5 mm, thick), and is curved to conform to the shape of the ITM drum (as is the heating unit, shown in FIG. 2). The grill may be made of any suitable rigid material, which may be non-metallic, such as plastic, or metallic. In some embodiments, the grill or support frame 27 may have a degree of flexibility.

The purpose of the holes 29 is to reduce the effective surface area of the grill to allow air to flow freely through the grill 27, without applying much force to the grill. As the effective surface area of the grill 27 (that is, the surface area not including the area of the holes) is small, the force the air flow exerts on the grill is small.

The holes 29 in the grill 27 may be of any shape or size. The number and size of the holes may vary depending on the flow rate of the air. A grill with a lower surface area may be required if it is to remain stationary in higher flow rate of air. However, the grill must not have so many holes that it is no longer substantially rigid, or at least rigid enough for the purpose that follows (some degree of flexibility may be allowable). The grill is provided as a paper-engaging body. All that is required is that the grill covers an area large enough to support or engage a sheet of paper (for example, a wide enough area to obstruct both the largest and smallest sheets recommended for use with the printer comprising the paper sensor, and prevent them passing through or around the grill), but has a low effective surface area so that air can flow through the grill without exerting much force on the grill. It will be appreciated that any support structure that meets those two criteria could be used in place of one of the grills shown in the Figures.

Figure 2:
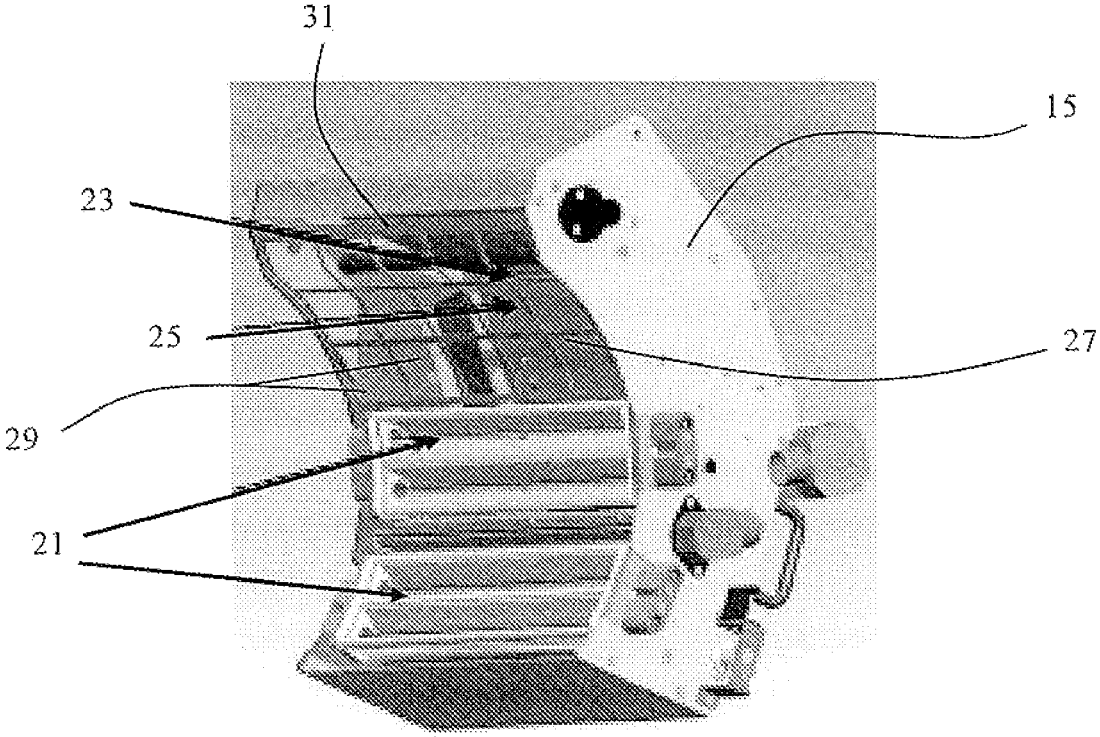
FIG. 2 shows a perspective view of an external heating unit used in the printer of FIG. 1 and including a paper sensor.
Figure 3:
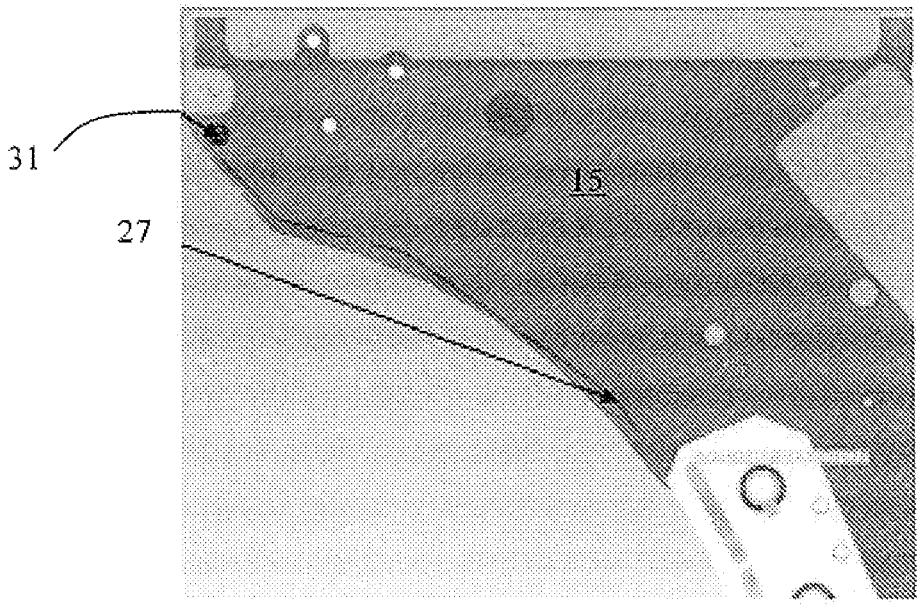
FIG. 3 shows a cross section through the heating unit of FIG. 2 in which the paper sensor is in a normal position.
Figure 4:
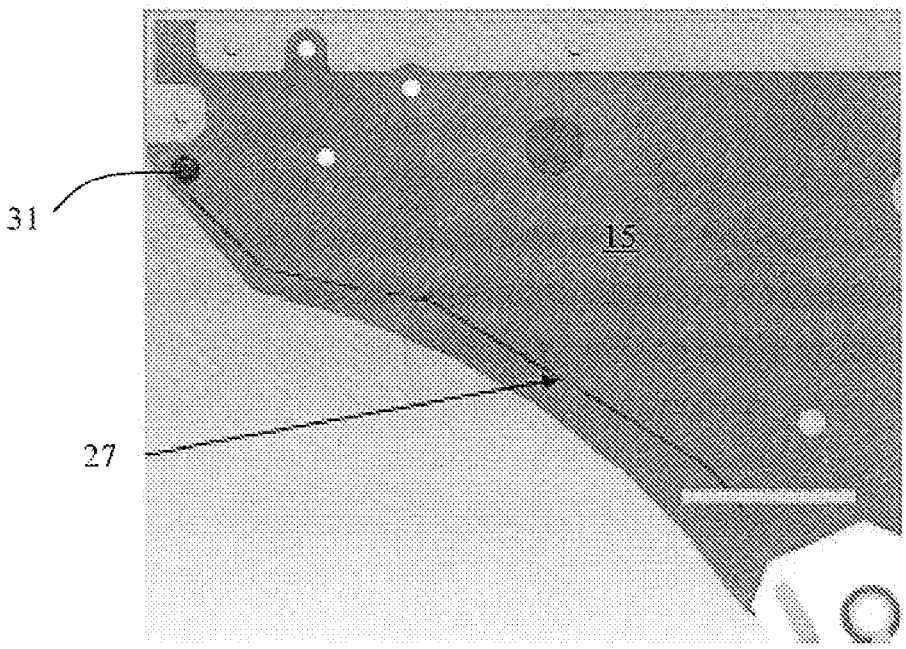
FIG. 4 shows a cross section through the heating unit of FIG. 2 in which the paper sensor is in an activated position.
Figure 5A:
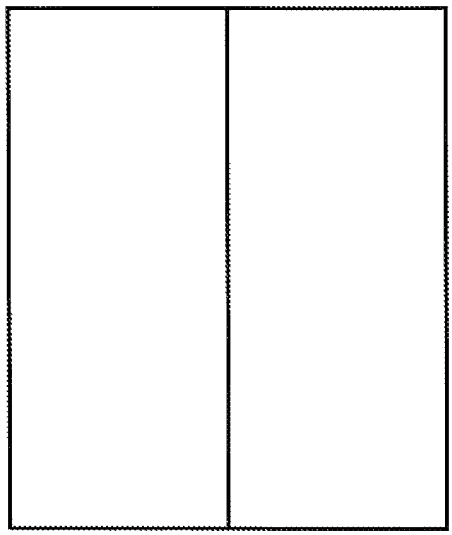
FIGS. 5*a* and 5*b* show alternative embodiments of a paper sensor grill.
Figure 5B:
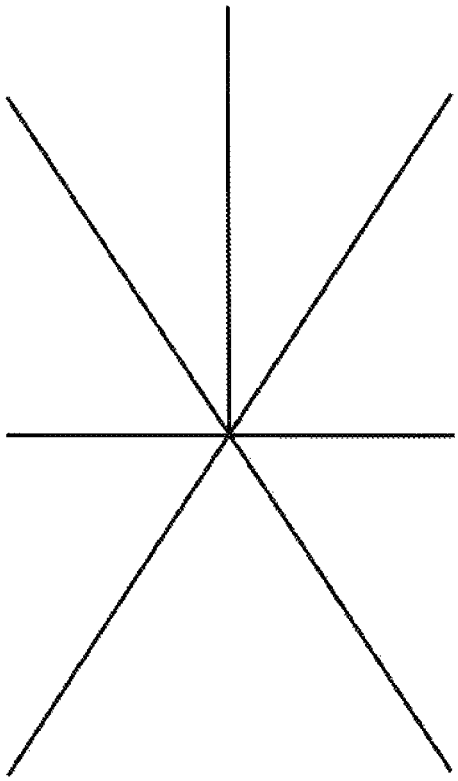

Two examples of alternative grills to the one shown in FIGS. 2 to 4 are shown in FIGS. 5*a* and 5*b*. FIG. 5*a* shows a rectangular frame, while FIG. 5*b* shows a substantially star-shaped frame. Neither of the grills shown in FIGS. 5*a* and 5*b* is of a conventional grid-like shape, but each is arranged to span a major portion (for example, greater than 60%) of the surface area of a sheet of paper, while having a low effective surface area.

The grill 27 is pivotally mounted about an axis 31, such that when it is in use the grill can move between a first, normal, position, shown in FIG. 3, and a second, activated, position, shown in FIG. 4. The grill 27 can move freely between the two positions, but is designed or weighted so that ordinarily it hangs in the first position under the influence of gravity, with air flowing through the holes. The grill might be biased to the first position in some way, for example using a biasing mechanism such as a spring, instead of, or as well as, by gravity.

When a sheet of paper sticks to ITM blanket 13*a*, it may be mistakenly directed towards the heating elements 21. However, before the paper reaches those heating elements 21 it must pass in front of the grill. As the paper is carried in front of the grill it is sucked towards the grill by the vacuum source 15*a*. The paper covers and blocks one or more of the holes 29 in the grill 27. Blocking a hole or holes in the grill 27 increases the effective surface area of the grill and so inhibits the flow of air through the grill. Air presses on the paper, which in turn presses on the grill. The force on the grill is increased, and the grill is pushed towards the vacuum source by the paper under the air pressure (this can be thought of as the vacuum source 15*a* sucking the paper towards itself). This occurs because the vacuum source 15*a* is only able to suck air and vapours from the interior of the printer at a reduced rate, through the few (if any) holes in the grill that remain uncovered) but continues to suck air from the interior of the heating unit 15 at its normal, relatively higher, rate. This results in the pressure inside the heating unit 15 being lowered, and a pressure differential being created across the grill 27. That pressure differential causes the grill to move from the first position shown in FIG. 3 to the second position shown in FIG. 4. The grill moves by pivoting, or tilting, about the axis 31.

A small sensing device, which may be for example a micro-switch, detects the fact that the grill has moved to the second position. The sensing device may be located on the grill itself, or adjacent the grill, for example inside the heating unit.

At least some embodiments of the invention use electro-mechanical transducers. These can be more reliable than optical sensors and do not suffer from optical signal degradation due to dirt in the machine as in prior art sensors. Electro-mechanical sensors can also be simple and cheap.

As an alternative, an optical sensor may be used. Prior art paper sensors comprising optical sensors have a problem in that the sensor can become dirty over time, resulting in optical signal degradation. However, in an embodiment of a paper sensor in accordance with the invention, an optical sensor may be shielded by the grill, so that it is only exposed when the grill is moved, reducing opportunity for debris to cover the sensor.

In other embodiments, the grill need not move. For example, a piezoelectric sensor may be used to detect the increase in pressure on the grill when a sheet of paper covers the holes in the grill.

Whatever switch, transducer, or sensing device is chosen for the paper sensor, that sensing device outputs a signal to printer controller 33 (FIG. 1). Printer controller 33 may output an alarm to a printer operator via a user interface 35, such as a touch screen or keyboard and display, or using an audible warning, to allow the operator to halt the printer. Alternatively, printer controller 33 may, upon noticing a 'paper-is-present' signal from the sensor, automatically shut down the printer, or the heating element, and optionally also instruct the printer operator to clear the stray paper from the paper sensor 23.

Figure 6:
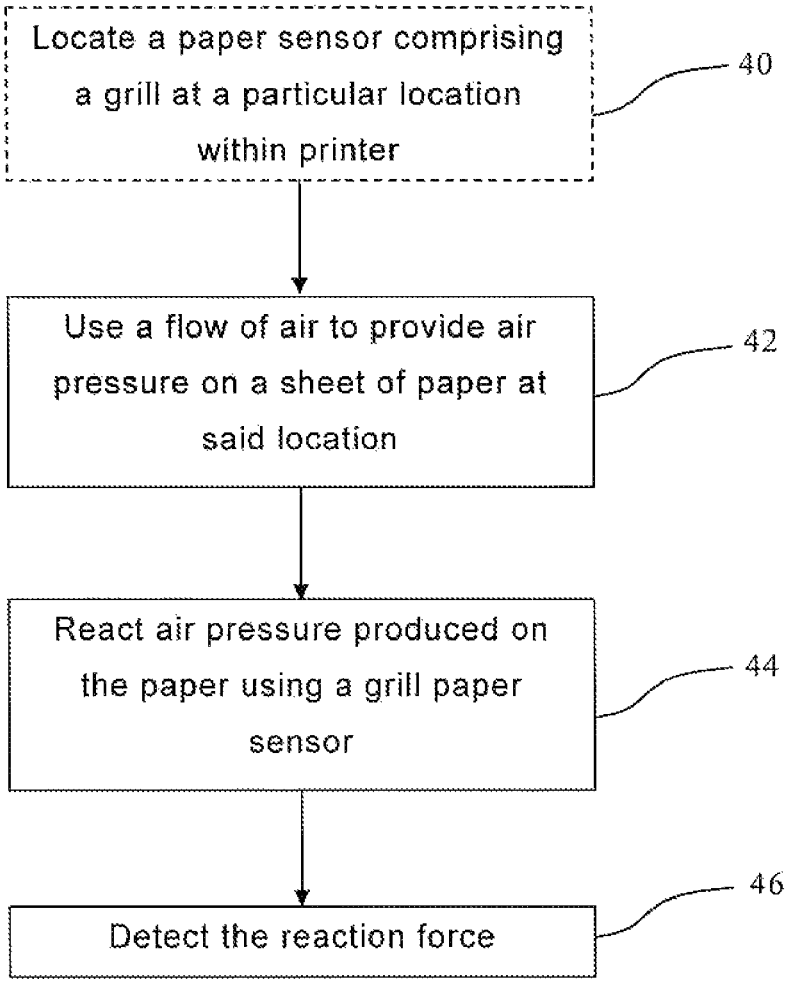
FIG. 6 is a flow chart depicting a method of paper sensing in accordance with the invention.

A method of paper sensing using an embodiment of a paper sensor will now be described, with reference to FIG. 6. At step 40, a paper sensor comprising a grill is positioned at a particular location within a printer. That particular location is a location at which it ifs desired to sense the existence of paper. This method step may occur separately of the other steps, for example in a factory during assembly of the printer.

The sensor may be arranged within the printer such that a flow of air normally flows through the grill-like paper detection member, but is obstructed by a sheet of paper positioned across holes in the grill. At step 42, the flow of air is used to provide air pressure on a sheet of paper at said location. At step 44, that air pressure is reacted against by the grill of the paper sensor. That is, the air pressure on the paper causes an increase in the force on the grill when paper is present in comparison to when paper is not present (ie there is an increase in the differential pressure across the grill). In step 46, the existence of (or a change in) the reaction force is detected. The grill may move from a first 'paper-is-not-present' position to a second 'paper-is-present' position due to the increased force on the grill.

Although such a paper sensor has been described in relation to the external heating unit of a printer it will be apparent to the skilled man that the paper sensor could be positioned elsewhere within a printer, if required, as long as a flow of air can be produced (for example sucked or blown) through the grill of the sensor in that location.

In addition to providing a sensing function, the paper sensor 23 creates a physical barrier that prevents stray paper from being carried further into an unwanted area, such as being sucked inside the heating unit 15 by the vacuum source 15*a*. Paper is held on the grill is and is prevented from travelling through the grill. In the case of the external heating unit, the grill moves further into the unit when paper is present, preventing from being carried directly in front of the heating elements 21, where it might be scorched, and possibly even reduces the risk of fire.

The invention claimed is:

1. A paper sensor comprising a moveable grill to move in response to contact with paper.

2. A paper sensor according to claim 1 and arranged for location within an air flow in a printer, the paper sensor comprising the grill as a paper-engaging body provided with a plurality of through holes such that air can flow freely through the grill, wherein the grill is operable to move between a first position and a second position, the paper sensor being arranged so that in use a sheet of paper introduced adjacent the grill engages the grill and reduces the air flow through one or more of the holes in the grill, creating a pressure differential across the grill, that pressure differential causing the grill to move from the first position to the second position, and thereby indicating the presence of paper.

3. The paper sensor of claim 1, further comprising a switch, wherein the switch is operable to detect that the grill has been moved from a first position to a second position.

4. The paper sensor of claim 1, wherein the grill is angularly moveable about an axis.

5. The paper sensor of claim 4, wherein the axis is located at or adjacent an edge of the grill.

6. The paper sensor of claim 1, wherein the grill is urged to a first position under the influence of gravity, and wherein the pressure of paper adjacent the grill is adapted to cause movement of the grill.

7. The paper sensor of claim 1, wherein the grill is urged to a first position by a resilient member.

8. A printer comprising a grill paper sensor to move in response to contact with paper.

9. The printer of claim 8, comprising an air flow source which in use creates an air flow, the paper sensor being located in the air flow, and the paper sensor comprising a grill provided with a plurality of through holes such that air can flow freely through the grill, wherein the grill is operable to move between a first position and a second position, the paper sensor being arranged so that a sheet of paper introduced in use adjacent the grill, upstream of the grill, reduces the air flow through one or more of the holes, generates a force applied to the grill by the paper due to the air flow, that force causing the grill to move from the first position to the second position.

10. The printer of claim 9, wherein the paper sensor is located adjacent a heating area of the printer.

11. The printer of claim 10, wherein the paper sensor comprises a physical barrier that prevents paper from entering the interior of the heating area.

12. The printer of claim 9, wherein the grill is angularly moveable about an axis.

13. The printer of claim 12, wherein the axis is located at or adjacent an edge of the grill.

14. The printer of claim 9, wherein the grill is biased to the first position by gravity.

15. The printer of claim 9, wherein the grill is biased to the first position by a resilient member.

16. The printer of claim 8, wherein the paper sensor further comprises a switch, the switch operable to detect that the grill has been moved from a first position to a second position.

17. A method of detecting the presence of paper at a particular location in a printer, the method comprising: using a flow of air to provide pressure on paper at said particular location; using a paper sensor to provide a reaction force to react to said air pressure force produced on the paper; and detecting said reaction force.

18. The method according to claim 17, used in a printer having a mesh-or grill-like detector member which has a relatively small effective surface area, the method comprising: producing a flow of air past the detector member and arranging for paper that is to be detected to contact the detector member upstream of the flow of air such that air pressure of the paper causes an increased force on the detector member when paper is present in comparison with the force due to the flow of air when paper is not present, the detector member being responsive to the change in force applied to it.

19. The method according to claim 18, wherein the detector member moves to a paper-is-present position from a paper-is-not-present position, when paper is present in front of it.

* * * * *